United States Patent [19]

Krowatachek

[11] Patent Number: 5,036,780

[45] Date of Patent: Aug. 6, 1991

[54] FEED DEVICE FOR A SEWING MACHINE

[75] Inventor: Fritz Krowatachek, Aachen, Fed. Rep. of Germany

[73] Assignees: PFAFF Industriemaschinen GmbH; Kochs Adler Aktiengesellschaft; Dürokoppwerke GmbH, all of Fed. Rep. of Germany

[21] Appl. No.: 524,781

[22] Filed: May 17, 1990

[30] Foreign Application Priority Data

May 18, 1989 [DE] Fed. Rep. of Germany ..... 3916090

[51] Int. Cl.[5] ..... D05B 27/00

[52] U.S. Cl. ..... 112/304; 26/94; 112/311

[58] Field of Search ..... 26/52, 93, 94; 112/311, 112/19, 47, 80.32, 304, 121.26, 121.15

[56] References Cited

U.S. PATENT DOCUMENTS

| | | | |
|---|---|---|---|
| 3,120,688 | 2/1964 | Nash | 26/93 |
| 3,175,245 | 3/1965 | Kreeft et al. | 26/94 |
| 3,234,621 | 2/1966 | Hyatt | 26/93 |
| 3,432,894 | 3/1969 | Sass | 26/52 |
| 4,541,353 | 9/1985 | Engle | 112/304 |
| 4,644,882 | 2/1987 | Fenzl | 112/121.26 |
| 4,717,143 | 1/1988 | Spengler | 26/52 X |

FOREIGN PATENT DOCUMENTS

| | | |
|---|---|---|
| 2536260 B | 8/1977 | Fed. Rep. of Germany . |
| 3121118C2 | 8/1982 | Fed. Rep. of Germany . |

*Primary Examiner*—Werner H. Schroeder
*Assistant Examiner*—Paul C. Lewis
*Attorney, Agent, or Firm*—McGlew & Tuttle

[57] ABSTRACT

The present invention pertains to a feed mechanism for a sewing machine for displacement-free, near-edge connection of two flexible layers of fabric in the direction of sewing. The device, which is to be used as an attachment, consists essentially of a driven, endless feeding arrangement guided in the horizontal direction and a plurality of receiving elements which are designed as clamps. The receiving elements include clamp lower parts arranged at a vertically spaced location from the fabric support surface and clamp upper parts that can be actuated like pushbuttons, as well as a pressing element acting on the clamp upper parts.

With their edges that are to be connected, the fabric layers are fed into a flat feeding section and fixed and carried by a first clamp and continually fixed by consecutive clamps in the same position in the device, thus carried along the stitch formation site, and continuously released in the sewn state at a discharge point.

9 Claims, 2 Drawing Sheets

FEED DEVICE FOR A SEWING MACHINE

FIELD AND BACKGROUND OF THE INVENTION

The present invention pertains to a feed mechanism for a sewing machine for displacement-free, near-edge connection of two flexible fabric layers in the direction of sewing.

A device for the near-edge connection of two garment parts with different arc-shaped edge sections has become known from U.S. Pat. No. 4,541,353. This device has a feed chain which is guided horizontally over several guide wheels and has on its chain links downwardly directed needle pins for receiving and fixing the fabric to be sewn. The fabric to be sewn is held and fixed in a zone preceding the feed section, in which one of the garment parts is positioned in the horizontal position on the pins of this chain. A second garment part is subsequently fed in by means of a second chain which has upwardly directed needle pins and is arranged in the feed zone under the feed chain and is fixed in the desired position on the first garment part. The feed chain subsequently conveys the two garment parts, which are now positioned on it together one on top of another in the horizontal position by means of the needle pins, along the stitch line.

To guide this feed chain, a guide rail is arranged above the fabric support surface and a groove is provided in the fabric support surface under the chain course, and downwardly directed needle pins extend into this groove without contact.

It is disadvantageous that the device is nondetachably connected to the sewing station, that the garment parts are pierced through by the needle pins and that the needle pins of the lower chain do not pierce perpendicularly, the garment part positioned in the feed chain.

SUMMARY AND OBJECTS OF THE INVENTION

It is an object of the present invention to provide a feed mechanism to be used as an attachment which attaches two fabric layers to each other that are to be connected to each other and are in the horizontal position without displacement in the feed or sewing direction and which guides the two fabric layers, in the attached state, along the stitch line.

According to the invention, a feed mechanism for a sewing machine is provided comprising a driven endless feeding means for feeding fabric layers in an attached horizontal position to a stitch formation site without displacement and guiding means in a horizontal plane for guiding the feeding means, the feeding means including a plurality of receiving members in the form of clamps including clamping surfaces extending substantially in parallel to a fabric support surface. Each clamp includes a clamp lower part arranged at a vertically spaced location from the fabric support surface, and at least one pressing element acting on a clamp upper part for closing the clamps along a feed section.

The fabric layers lying one on top of another are fed into this feed mechanism in the zone in which the clamps swivel into the straight feed section and move along a straight line in the direction of the stitch formation site.

With their edges that are to be connected, the fabric layers are fed into the feed section and fixed and carried by the first closing clamp perpendicularly to the direction of feed. immediately thereafter, the subsequent fabric sections are fixed at the same point of the feed section by closure of the subsequent clamps.

Due to the fact that the clamping surfaces of the clamps are moved toward each other perpendicularly to the fabric layers, a relative movement between the fabric layers is avoided and displacement in the direction of feed and consequently in the direction of sewing is ruled out.

The feed chain or a stop provided as a clamp lower part in parallel to the direction of feed serves as the positioning aid for positioning the fabric layers at right angles to the direction of feed.

The fixed fabric layers are moved along the stitch formation site, sewn together, and subsequently released by opening the clamps.

Due to the fabric layers being fixed without displacement, longitudinal equalization of the fabric layers to be attached to each other over the length or over part of the length is possible by stretching one fabric layer during feeding in.

The pushbutton-like design of the clamp upper parts and their actuation by a spring-tensioned and beveled rail represents a simple and effective closing mechanism.

It is advantageous to fasten the clamp upper parts to two pins arranged in parallel which can be actuated by the beveled rail, because, in cooperation with the spring-tensioned rail, nearly canting-free and plane-parallel lowering of the clamp upper parts to the clamp lower parts can thus take place.

In addition, the upper clamping surfaces will be provided with an elastic lining which makes it possible to compensate for unevennesses caused by the fabric to be sewn.

To improve sliding of the sliding heads on the rail, it is advantageous to design their sliding surface as a convex surface.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
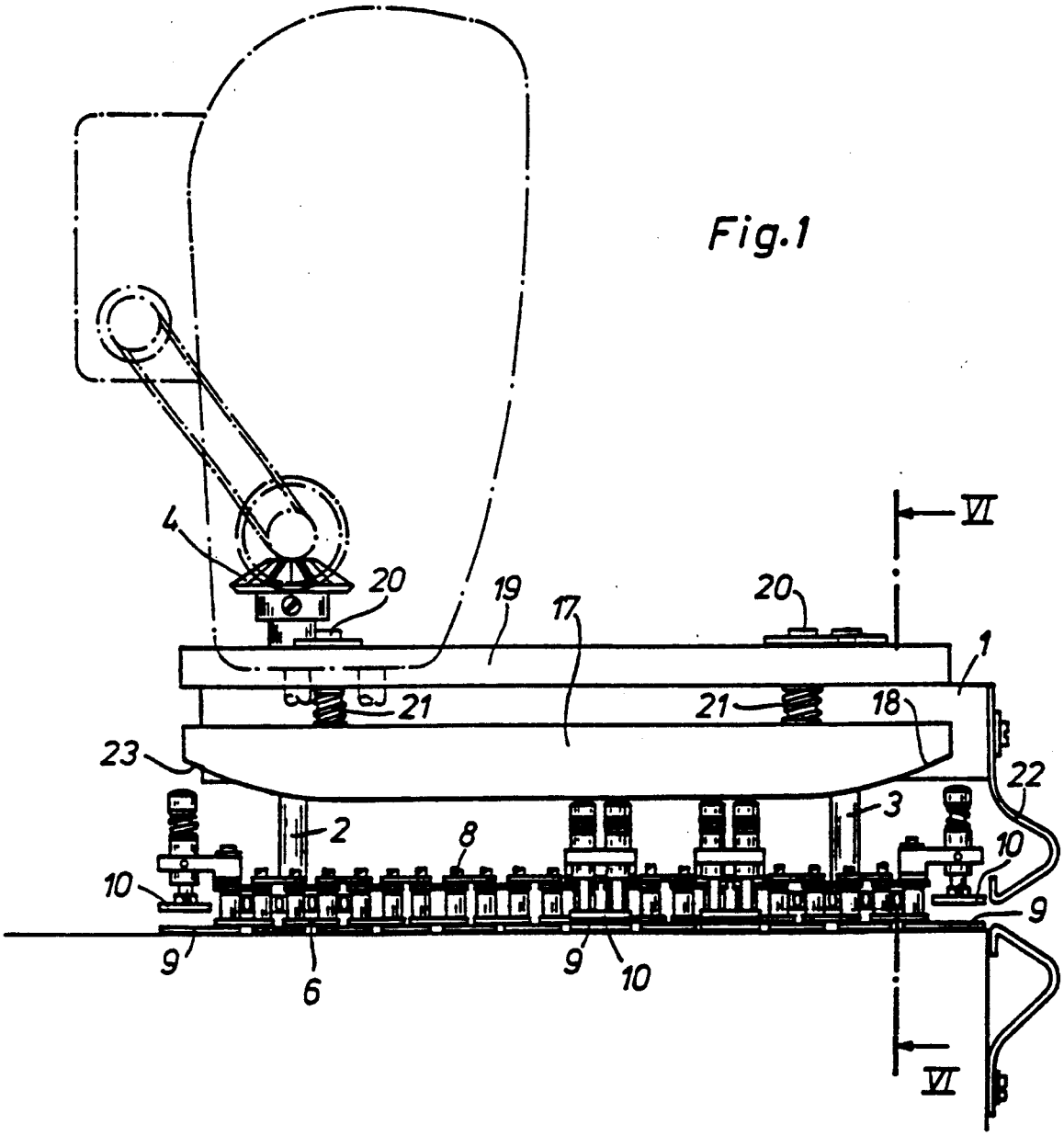
FIG. 1 is a front view of a feed mechanism according to the present invention.
Figure 2:
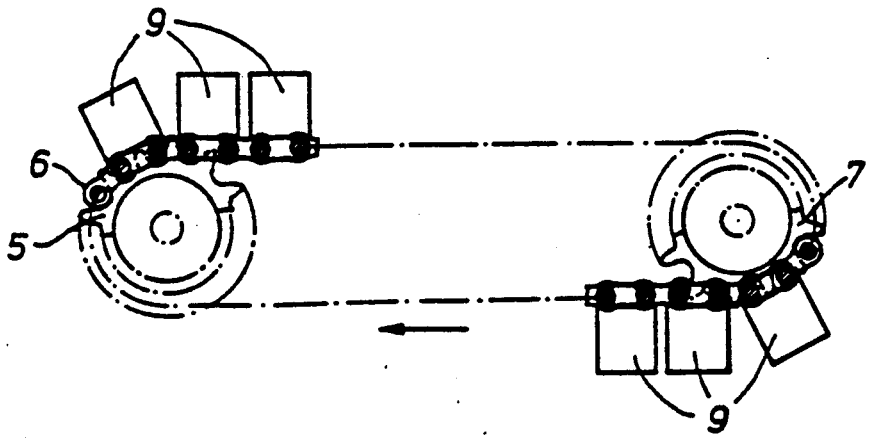
FIG. 2 is a schematic representation of the top view of the course of the feed chain.

The device according to the present invention has a base 1 which is fastened to the head of the sewing machine. Shafts 2 and 3 are mounted on the base, wherein the shaft 2 is the drive shaft for the feed chain and is connected to the main shaft of the sewing machine via a bevel gear 4. At the base of the shaft is mounted a spur gear 5 which serves as a driving gear for a feed chain 6 and whose mounting and guiding are complemented by a spur gear 7 fastened to the shaft 3.

Figure 3:
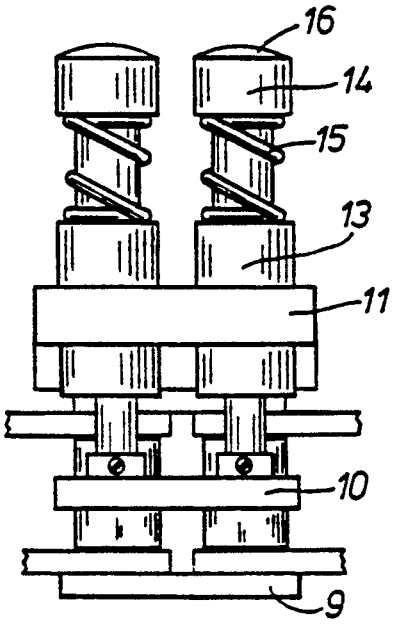
FIG. 3 is a front view of a clamp according to the invention.
Figure 4:
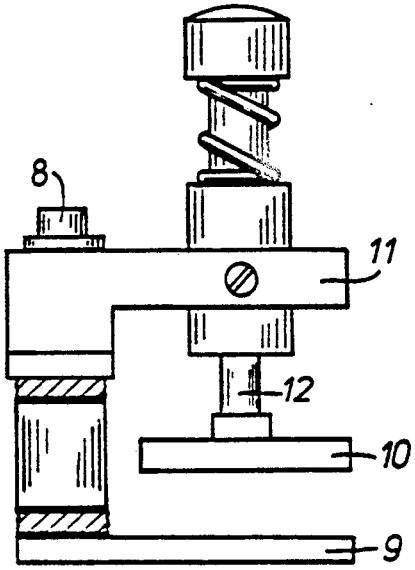
FIG. 4 is a side view of a clamp according to the invention.
Figure 5:
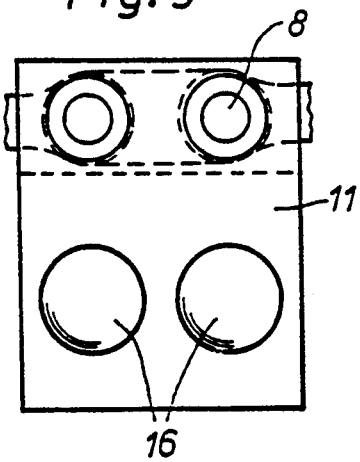
FIG. 5 is a top view of a clamp according to the invention.
Figure 6:
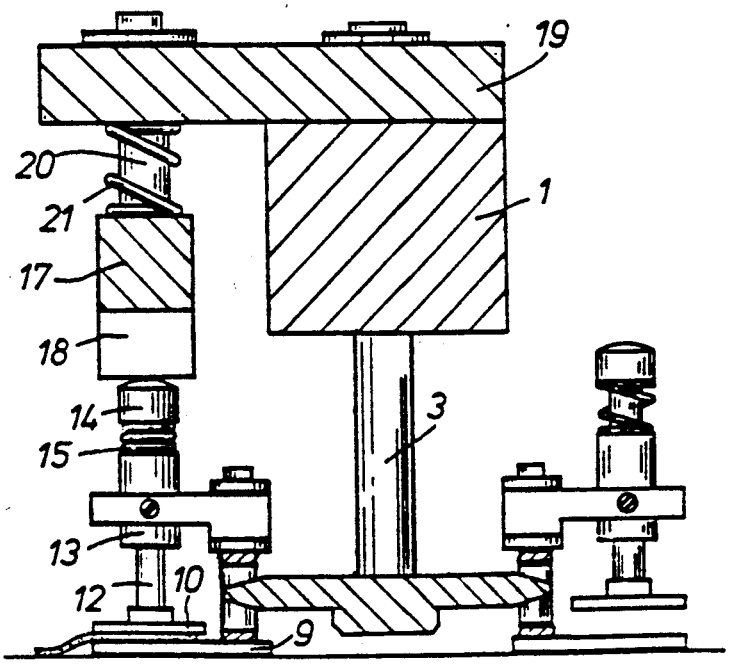
FIG. 6 is a sectional views taken through the feed mechanism according to the present invention.

The clamp lower parts 9 and the clamp upper parts 10 are arranged on two adjacent link pins 8, each forming a part of the feed chain 6 (FIGS. 3 and 4). A holding member 11, which is arranged on two adjacent link pins 8 on the upper side of the chain, serves to fasten a clamp upper part 10. The clamp upper part 10 is actuated as a pushbutton by the sliding heads 14 against the compression springs 15 via pins 12 which are arranged movably in the sleeves 13 rigidly connected to the holder 11. The sliding surface 16 of the sliding heads is slightly convex. To apply the necessary pressure to the sliding heads, the spring-tensioned rail 17 with the entry slope 18 is arranged above the sliding heads in the direction of feed, wherein the rail 17 presses the sliding heads 14 and consequently the clamp upper parts 10 vertically in the downward direction during feed motion (FIGS. 1 and 6). The spring-tensioned mounting of the rail is guaranteed by the pins 20 arranged movably in the axial direction in plate 19 and by the compression spring 21. The plate 19 is arranged nonmovably on the base 1.

A guide plate 22 which facilitates the feeding of the fabric to be sewn and extends to the level of the lower edge of the clamp upper part 10, flush with the straight feed section is arranged on the fabric feed side of the base 1.

The fabric layers are pushed into the straight feed section and fixed and transported by the first clamp, which is swiveled into this section and closes perpendicularly to the fabric to be sewn. The subsequent clamps consecutively grasp subsequent fabric sections in the same manner and thus transport the fabric to be sewn in the direction of sewing to the stitch formation site without displacement.

Immediately before swiveling off from the straight section after passing by the stitch formation site, the clamps open as a consequence of the exit slope 23 arranged and they consecutively release the fabric layers sewn together section by section.

While a specific embodiment of the invention has been shown and described in detail to illustrate the application of the principles of the invention, it will be understood that the invention may be embodied otherwise without departing from such principles.

What is claimed is:

1. A feed mechanism for a sewing machine, comprising: driven, endless feeding means including receiving members arranged for receiving fabric layers to be connected to one another in a horizontal position at a feed section, said receiving members including a plurality of clamps having clamping surfaces extending substantially in parallel to a fabric support surface, each of said clamps including a clamp lower part, arranged at a vertically spaced location from said fabric support surface, at least one upper part and pressing means pressing said upper part in a vertical direction toward said lower part for closing the clamps along said feed section, said feed means being guided in a horizontal plane from said feed section to beyond a stitch formation site of said sewing machine, said pressing means extending from said feed section to beyond said stitch formation site for pressing said upper part between said feed section and said stitch formation site, to maintain said fabric layers in a position set at said feed section, through said stitch formation site.

2. A feed mechanism according to claim 1, wherein said feed means comprises a feed chain.

3. A feed mechanism according to claim 2, wherein each of said lower parts and each of said upper parts are fastened to link pins of said feed chain, said clamping surfaces are arranged laterally on an outside of said feed chain, said upper parts connected to push-button elements which are actuated by said pressing means.

4. A feed mechanism according to claim 1, wherein said roller chain includes link pins, said clamp lower parts and said upper parts are connected in pairs to one of said link pins.

5. A feed mechanism according to claim 2, wherein said roller chain includes link pins, said clamp lower parts and said upper parts are connected in pairs to two of said link pins.

6. A feed mechanism according to claim 1, wherein said pressing means includes a spring-tensioned rail defining an entry slope and an exist slope for a sliding head member associated with each said clamp upper part.

7. A feed mechanism according to claim 1, wherein each said clamp upper part is fastened to two vertically arranged pins with an associated compression spring, each of said pins actuable against the force of said associated compression spring.

8. A feed mechanism according to claim 6, wherein said sliding head includes a convex sliding surface.

9. A feed mechanism for a sewing machine, comprising: driven, endless feeding means including receiving members arranged for receiving fabric layers to be connected to one another in a horizontal position at a feed section, said receiving members including a plurality of clamps having clamping surfaces extending substantially in parallel to a fabric support surface, each of said clamps including a clamp lower part arranged at a vertically spaced location from said fabric support surface, at least one upper part and pressing means pressing said upper part in vertical direction towards said lower part for closing the clamps along said feed section, said feed means being guided in a horizontal plane said pressing means including a spring tensioned rail defining an entry slope and an exit slope for a sliding head member associated with each said clamp upper part.

* * * * *